US006563401B1

(12) United States Patent
Abbas et al.

(10) Patent No.: US 6,563,401 B1
(45) Date of Patent: May 13, 2003

(54) OPTIMIZED RESONATOR FILTER

(75) Inventors: Farhat Abbas, Twickenham (GB); Ran-Hong Yan, Farington (GB)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/689,171

(22) Filed: Oct. 12, 2000

(30) Foreign Application Priority Data

Oct. 18, 1999 (EP) ..... 99308191

(51) Int. Cl.[7] ..... H01P 1/20
(52) U.S. Cl. ..... 333/202; 333/219.1
(58) Field of Search ..... 333/202, 219.1

(56) References Cited

U.S. PATENT DOCUMENTS 4,559,490 A * 12/1985 Gannon et al. ..... 333/202
4,714,903 A * 12/1987 Brand ..... 333/110
5,179,074 A * 1/1993 Fiedziuszko et al. ..... 505/1
5,781,085 A * 7/1998 Harrison ..... 333/202

OTHER PUBLICATIONS

"Modeling of Cylindrical Dielectric Resonators in Rectangular Waveguides and Cavities" by Xiao–Peng Liang, Hsin–Chin Chang and Kawthar A. Zaki, Elecrical Engineering Department, University of Maryland, College Park, MD 20742, 1993 IEEE MTT–S Digest.

Chi Wang, et al "Mixed Modes Cylindrical Planar Dielectric Resonator Filters with Rectangular Enclosure" IEEE Transactions On Microwave Theory and Techniques, vol. 43, No. 12, part 2, Dec. 1, 1995 New York, NY, pp. 2817–2823.

Jean–Pierre Cousty, et al "Finite Elements for Microwave Device Simulation: Application to Microwave Dielectric Resonator Filters" IEEE Transactions on Mircowave Theory and Technique, vol. 40, No. 5, May 1, 1992, New York, NY pp. 925–932.

European Search Report, dated Mar. 22, 2000.

* cited by examiner

*Primary Examiner*—Robert Pascal
*Assistant Examiner*—Joseph Chang

(57) ABSTRACT

The dimensions of a resonator filter comprising at least one puck (12, 14) in a metal cavity (16) are calculated by deriving the diameter c and thickness j of the puck, the spacing of the puck from the cavity walls by a mode-matching technique, then optimized by applying electromagnetic simulation of a full filter response. Other dimensions of the puck may also be optimized. If two or more pucks are present in the cavity, the inter-puck spacing is also optimized.

8 Claims, 3 Drawing Sheets

OPTIMIZED RESONATOR FILTER

CROSS-REFERENCE TO RELATED APPLICATION

This application claims priority of European Patent Application No. 99308191.8, which was filed on Oct. 18, 1999.

BACKGROUND OF THE INVENTION

1. Field of the Invention

This invention relates to an optimised resonator filter, i.e. to a filter having dimensions optimised by a new method, and to a method for such dimension optimisation.

2. Description of Related Art

In wireless telecommunications at microwave frequencies, duplexers are used to transmit to and receive signals from an antenna. Currently available duplexers, which must have specified performance over a wide range of working temperatures, and required dimensions, carry material costs in the need to provide irises and tuning screws, and time costs in the need for a skilled person to tune the resonator before use.

A mode-matching technique for the derivation of the response of a filter, using the dimensions of a resonator cavity and dielectric puck, has been published by D Kajfez and P Guillon, Dielectric Resonators, Oxford MS: Vector Fields, 1990.

Computer programs to derive a full filter response, based on electromagnetic simulation techniques, are commercially available.

SUMMARY OF THE INVENTION

It has now been realised that such programs can be used to optimise the parameters of a filter, and that the results can be used in filter design.

It is an object of the invention to provide a resonator filter which does not need an iris or tuning or coupling screws but which still meets all technical requirements.

According to the invention a method of optimising the characteristics of a resonator filter comprising a dielectric puck in a conducting cavity characterised by deriving the diameter c and thickness j of the puck by a mode-matching technique; and optimising the diameter c and thickness j of the puck by electromagnetic simulation of a full filter response.

Also according to the invention a resonator filter comprising a puck of dielectric material within a conducting cavity, the diameter and thickness of the puck having been optimised by a method as set out above. Such a filter does not require tuning or coupling screws or an iris.

BRIEF DESCRIPTION OF THE DRAWINGS

The invention will now be described by way of example with reference to the accompanying drawings in which.

DETAILED DESCRIPTION

Figure 1:
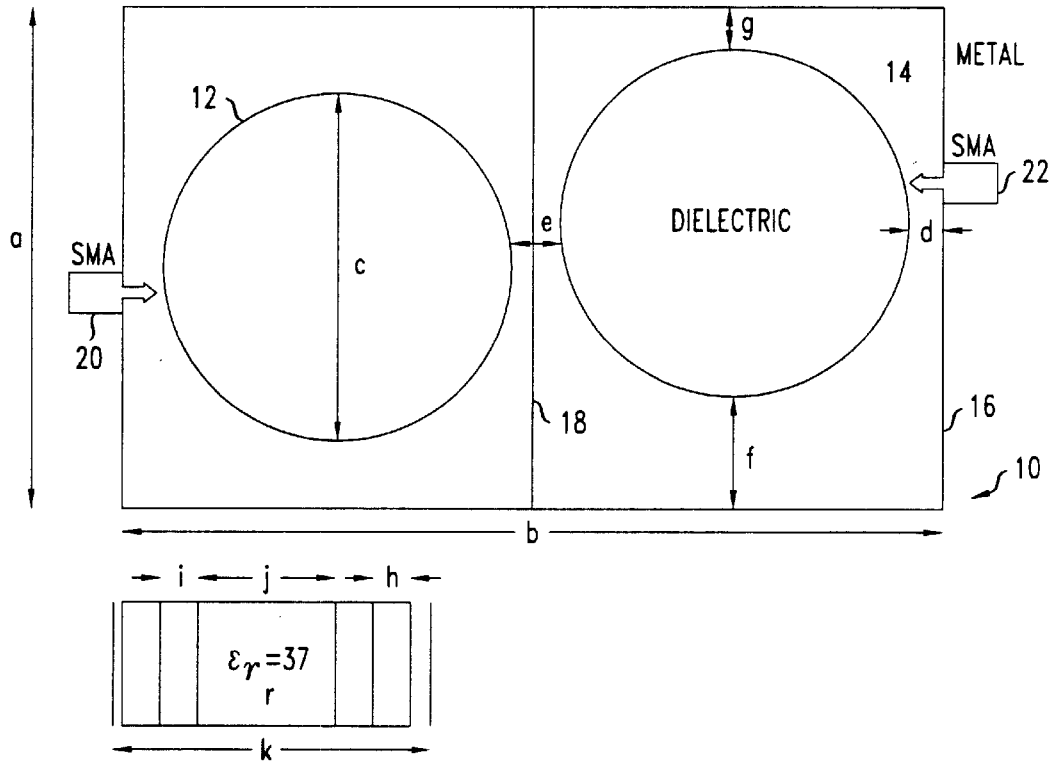
FIG. 1 is a schematic drawing of a cavity resonator.

In FIG. 1, a cavity resonator 10 comprises two disc-shaped pucks 12,14 of dielectric material within a metal cavity 16. The cavity had a dividing wall 18 between the pucks, and two SMA radio frequency connectors 20, 22.

The dimensions of the cavity 16 are a, b where b=2a. Assume the two pucks 12, 14 are of identical dimensions. The puck diameter is c, the spacing of the puck 14 from the connector-bearing end wall is d, and from the two side walls of the cavity is f, g; the spacing between the pucks 12, 14 is e.

Considering now further dimensions, j=length of the puck; h, i=the thickness of the puck support material; and k=total puck height, that is k=h+j+i.

The cavity 16 may be made of aluminium, and the pucks 12, 14 may be made of barium titanate, such as the material Ceramic D8300 (TM) supplied by Trans-tech of Adamstown, Md., USA, which has a dielectric constant of 37, a quality factor of 28,000 and an ultra-stable temperature coefficient of resonant frequencies.

Figure 2:
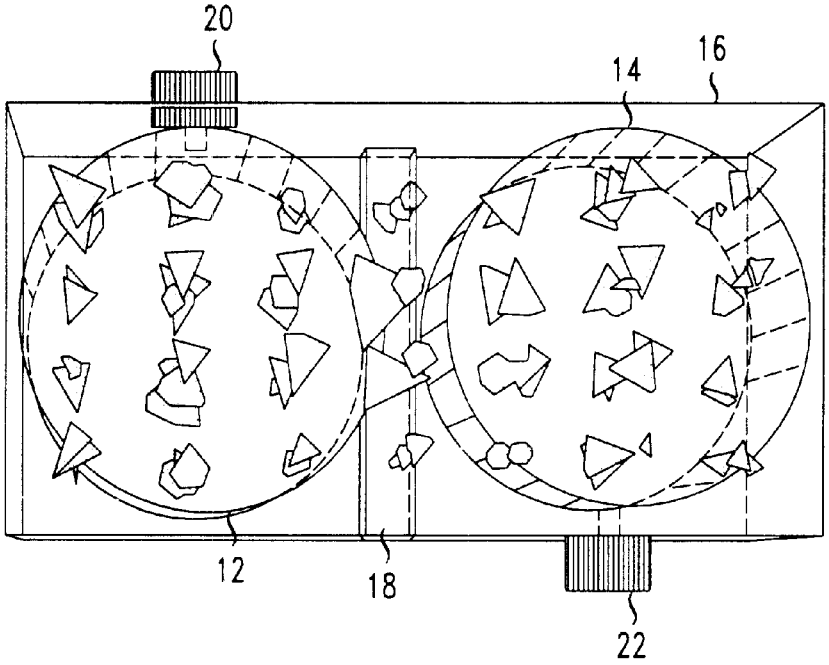
FIG. 2 illustrates electromagnetic plots of the FIG. 1 resonator.

FIG. 2 illustrates the electromagnetic field plots of the resonator shown in FIG. 1. The RF connectors 20, 22 are shown at different positions on the enclosure 16.

As is well known, for strong coupling between the pucks 12, 14, the dividing wall 18 can be removed; for weak coupling, the wall is left in place. For pucks with high permittivity, a wall may not be necessary.

Considering now the optimisation technique; in the first step, the mode-matching technique of Kajfez is applied to derive all of the dimensions a to k; in the second step the derived parameters are loaded into an electromagnetic simulator program, such as the CST Microwave Studio 3D program which is based on a finite integration technique with perfect boundary approximation for three-dimensional electromagnetic simulation. The program is run to optimise the parameters, and the optimised parameters are then used to design a filter.

It has not previously been realised that such simulation programmes can be used to optimise the resonator parameters, with the result that tuning and coupling screws are no longer needed. The parameters are optimised by minimising the value of $S_{11}$, which is the reflection coefficient of the microwave in the band of the filter for each of the parameters a to k.

The technique may be applied to a single puck within a cavity. The technique may also be applied to a selected number of the dimensions shown in FIG. 1; for a single puck, the most important dimensions are c, d, f, g and j. For two pucks in a cavity, the next most important dimension is the inter-puck spacing e.

For a Ceramic D8300 (TM) puck with a permittivity of 37 in an aluminium cavity, optimised dimensions are a=53 millimetres, b=96, c=33, d=5, e=10, f=7, g=3, h=5, i=5, j=16.5 and k=36.5. Typically the tolerances of the cavity wall dimensions are tens of micrometers.

In a further variation, the dimensions of a dividing wall 18 of the cavity are also optimised.

It has been found that a filter constructed with optimised parameters has a performance which is much more controllable and predictable than has previously been possible; the filter does not need tuning or coupling screws or an iris.

Figure 3A:
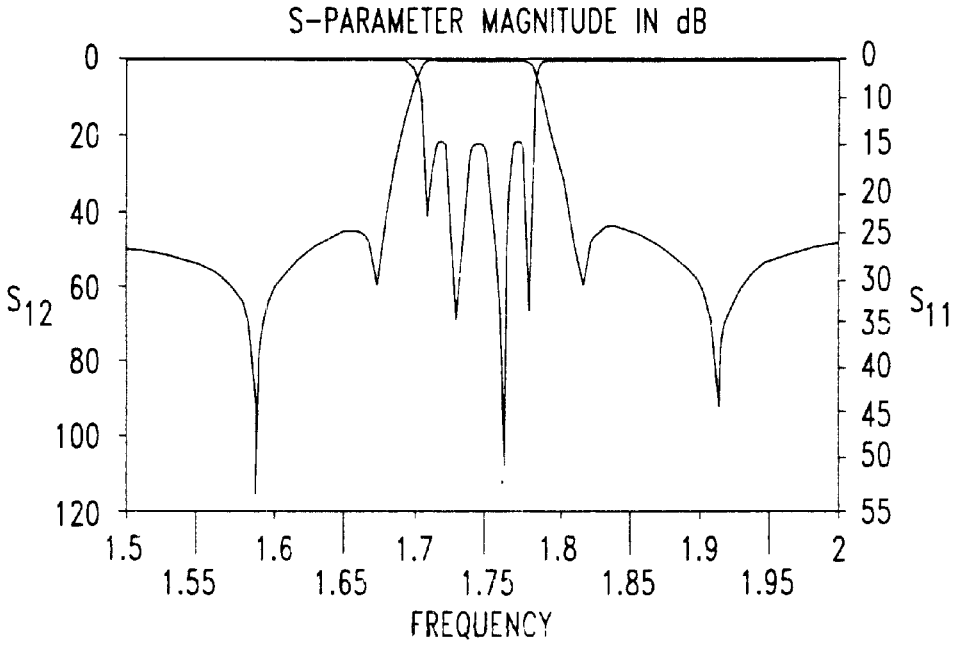
FIG. 3*a* is a calculated scattering parameter.
Figure 3B:
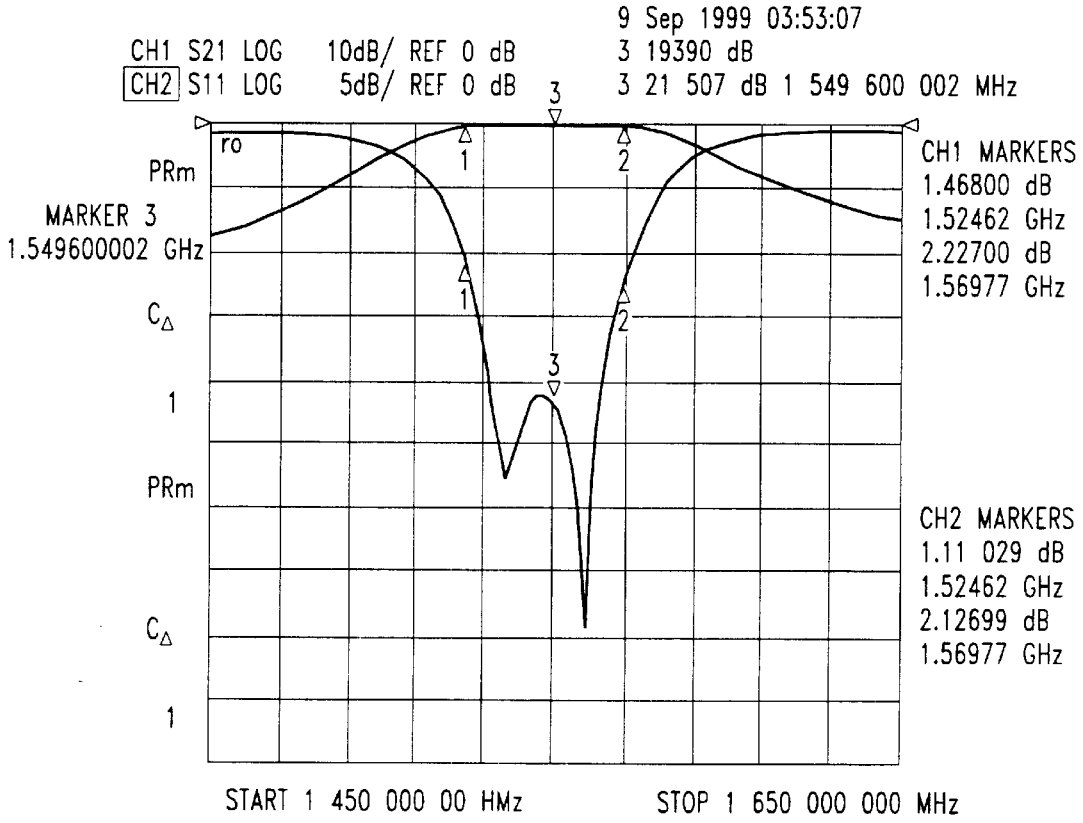
FIG. 3*b* is a measured scattering parameter.

FIG. 3 illustrates the calculated S-parameter magnitude in decibels for frequencies between 1.5 and $2\times10^9$, for a 4 pole elliptic filter without tuning or coupling screws, and FIG. 3*b* illustrates experimental values of the same parameter. In both figures the insertion loss is 0.19 dB, return loss is 21 dB, and out of band loss is 20 dB.

An advantage of a filter without tuning or coupling screws or an iris is that the most expensive machined parts of the filter, which require expensive materials and tight tolerances, and the skill and therefore the time cost needed to tune a prior art filter, are no longer required.

Another advantage is that lower mid-band insertion losses are achievable than with a comparable filter having an iris and tuning and coupling screws, because conduction currents in the metallic cavity ends are eliminated.

A further advantage is that the physical size of the resonator can be reduced by a factor of 12 in comparison with an air filled resonator, by use of high dielectric constant and high quality factor dielectric material such as Ceramic D8300.

One application of a filter according to the invention is a duplexer in a microwave wireless communication system; such a duplexer is provided in the base stations of the GSM (Global System for Mobile Communications), when the front-end filtering requirement is 90 dB attenuation in the stop-band; such a requirement can be met by a filter according to the invention.

What is claimed is:

1. A method of optimising the characteristics of a resonator filter comprising a dielectric puck in a conducting cavity without an iris and without a tuning or coupling screw, the method comprising deriving the diameter and thickness of the puck by a mode-matching technique and optimising the diameter and thickness of the puck by electromagnetic simulation of a full filter response using a three dimensional finite integration technique.

2. A method according to claim 1 further comprising deriving the spacing of the puck from the cavity wall by a mode-matching technique; and optimising the spacing of the puck from the cavity wall by electromagnetic simulation of a full filter response using a three dimensional finite integration technique.

3. A method according to claim 1 further comprising deriving and optimising the thickness of the puck support material and the total puck thickness.

4. A method according to claim 1 in which there are a plurality of pucks in the cavity further comprising optimising the separation e of the pucks from each other.

5. A resonator filter comprising a puck of dielectric material within a conducting cavity without an iris and without a tuning or coupling screw wherein the diameter and thickness of the dielectric puck are optimised by deriving the diameter and thickness of the puck by a mode-matching technique and optimising the diameter and thickness of the puck by electromagnetic simulation of the full filter response using a three dimensional finite integration technique.

6. A resonator filter comprising a dielectric puck in a conducting cavity without an iris and without a tuning or coupling screw, produced by deriving the diameter and thickness of the puck by a mode-matching technique and optimising the diameter and thickness of the puck by electromagnetic simulation of a full filter response using a three dimensional finite integration technique in which the thickness of the puck support material and of the total puck thickness are optimised.

7. A resonator filter comprising a puck of dielectric material within a conducting cavity without an iris and without a tuning or coupling screw wherein the diameter and thickness of the puck are optimized by deriving the diameter and thickness of the puck by a mode-matching technique and optimising the diameter and thickness of the puck by electromagnetic simulation of a full filter response using a three dimensional finite integration technique in which the spacing of the puck from the cavity wall is optimised by deriving the spacing of the puck from the cavity wall by a mode-matching technique; and optimising the spacing of the puck from the cavity wall by electromagnetic simulation of a full filter response using a three dimensional finite integration technique.

8. A resonator filter comprising a plurality of pucks of dielectric material within a conducting cavity without an iris and without a tuning or coupling screw, produced by deriving the diameter and thickness of the puck by a mode-matching technique and optimising the diameter and thickness of the puck by electromagnetic simulation of a full filter response using a three dimensional finite integration technique wherein the dimensions of the puck, the dimensions of the cavity, and the spacing of the pucks from each other are optimised.

* * * * *